US006976770B2

(12) United States Patent
Trimpe et al.

(10) Patent No.: US 6,976,770 B2
(45) Date of Patent: Dec. 20, 2005

(54) HERMETICALLY SEALED LAMP HOUSING AND METHOD OF MAKING

(75) Inventors: Kenneth L. Trimpe, Pendleton, IN (US); Clifford G. Ambler, Anderson, IN (US); Christopher E. Barron, Indianapolis, IN (US)

(73) Assignee: Guide Corporation, Pendleton, IN (US)

( * ) Notice: Subject to any disclaimer, the term of this patent is extended or adjusted under 35 U.S.C. 154(b) by 278 days.

(21) Appl. No.: 10/270,821

(22) Filed: Oct. 14, 2002

(65) Prior Publication Data

US 2004/0070988 A1 Apr. 15, 2004

(51) Int. Cl.[7] ..... F21V 17/00; B60Q 1/00

(52) U.S. Cl. ..... 362/362; 362/267; 362/516; 362/548

(58) Field of Search ..... 362/362, 267, 362/546, 519

(56) References Cited

U.S. PATENT DOCUMENTS

| | | | | |
|---|---|---|---|---|
| 4,264,944 A | | 4/1981 | Deverrewaere | |
| 4,463,278 A | | 7/1984 | Kosmatka et al. | |
| 4,479,072 A | | 10/1984 | Gaugel et al. | |
| 4,641,056 A | | 2/1987 | Sanders et al. | |
| 4,642,514 A | | 2/1987 | English et al. | |
| 4,646,215 A | | 2/1987 | Levin et al. | |
| 4,723,198 A | | 2/1988 | Levin et al. | |
| RE32,624 E | * | 3/1988 | Myles et al. | 362/548 |
| 4,743,654 A | | 5/1988 | Kyu et al. | |
| 4,938,563 A | | 7/1990 | Nelson et al. | |
| 4,947,078 A | | 8/1990 | Rice et al. | |
| 4,950,942 A | | 8/1990 | Braun et al. | |
| D314,636 S | | 2/1991 | Iacovelli | |
| 5,163,746 A | | 11/1992 | Lisak | |
| 5,172,999 A | | 12/1992 | Ijima et al. | |
| 5,181,429 A | | 1/1993 | Sieber | |
| 5,327,330 A | | 7/1994 | Van Oel et al. | |
| 5,442,525 A | * | 8/1995 | Tsukada | 362/548 |
| 5,550,190 A | | 8/1996 | Hasegawa et al. | |
| 5,610,472 A | | 3/1997 | Schmitt, Jr. | |
| 5,696,424 A | | 12/1997 | Coushaine | |
| 5,709,450 A | | 1/1998 | Francis et al. | |
| 5,736,811 A | | 4/1998 | Westemeyer et al. | |
| 6,062,709 A | * | 5/2000 | Cunnien et al. | 362/267 |
| 6,080,019 A | | 6/2000 | Coushaine | |
| 6,210,014 B1 | | 4/2001 | Kubizne et al. | |
| 6,402,999 B1 | | 6/2002 | Sadr et al. | |
| 2003/0081427 A1 | * | 5/2003 | Judd et al. | 362/548 |

OTHER PUBLICATIONS

*HudsonOnline TechFiles: Thermostet vs. Thermoplastic*; www.rlhudson.com/tech_thermo.html; Jun. 24, 2002.

*Vibration welding of thermoplastic polymers*; www.lkt.uni–erlangen.de/forsch/verbin/f–svib–e.htm; Jun. 24, 2002.

*Thermoplastic polmers; Polymers*; http://www.learn.chem.vt.edu/tutorials/lsproperties/thermoplastic.html; Jun. 24, 2002.

(Continued)

*Primary Examiner*—Stephen Husar
*Assistant Examiner*—James W Cranson
(74) *Attorney, Agent, or Firm*—Ice Miller

(57) ABSTRACT

The present invention comprises a lamp assembly with a boot hermetically cohered to the housing. The housing comprises a thermoplastic polymer and the boot comprises a thermoplastic elastomer. The boot is cohered to the housing by welding. According to one embodiment, the boot is sonic or vibration welded to the housing. The present invention may be used in the production of a wide range of lamp assemblies, including vehicle headlamp assemblies.

12 Claims, 3 Drawing Sheets

OTHER PUBLICATIONS

*Advanced Elastomer Systems: News & Events Advanced Elastomer Systems Introduces Themoplastic Elastomers With Metal and Textile Bonding Capabilities*; www.santoprene.com/site/Resource_Libraries/News/1742.html; Jun. 18, 2002.

*Advanced Elastomer Systems: Santoprene 8000*; www.santoprene.com/site/products/3299.html; Jun. 18, 2002.

*The Fred Werner Company—About Santoprene*; www.fredwernerco.com/santoprene.html; Jun. 18, 2002.

*GLS Template*; www.glscorporation.com/whataretypes.cfm; Jun. 11, 2002.

* cited by examiner

HERMETICALLY SEALED LAMP HOUSING AND METHOD OF MAKING

FIELD OF THE INVENTION

This invention relates to vehicle lamp assemblies and, in particular, to a novel method for hermetically sealing lamp assemblies having an adjustable reflector.

BACKGROUND OF THE INVENTION

Generally, vehicles, especially automobiles, are equipped with a wide variety of lights serving many different purposes. These purposes include dashboard lighting, interior overhead lighting, exterior lighting, trunk lighting and under-hood lighting, to name only a few. An even wider variety of lighting needs are presented by boats, air planes and other vehicles. Typical light assemblies include a housing with a lens and an opening in the housing for access to a lamp inside the housing.

In many applications, an adjustable reflector is mounted within the housing. With this type of lamp assembly, the housing is mounted securely to the vehicle, and the reflector position is adjusted within the housing to modify the direction of the beam of light emitted by the light assembly. Access to the rear portion of the reflector is provided by an opening in the housing. This allows for replacement of the lamp which is mounted to the reflector. Accordingly, the opening in the housing is substantially aligned with the rear of the reflector for easy access to the lamp.

The above described arrangement, while very useful in allowing for replacement of the lamp, increases the susceptibility of the light assembly to degraded performance due to the introduction of water, dirt or other debris into the lamp assembly. Accordingly, it is known to provide a sealing member between the light assembly housing and the reflector. Because the reflector is moveable, any such sealing member must be capable of allowing relative motion between the housing and the boot. One approach to providing a sealing member is to use flexible material. One such material is Ethylene Propylene Diene Monomer (EPDM) rubber.

EPDM possesses a number of desired characteristics. EPDM is capable of withstanding wide temperature variations without cracking or deteriorating. EPDM also offers high tensile strength, extreme elongation capabilities to several times its original size, and is generally compatible with other materials used in light assemblies. In a typical light assembly using EPDM, the rubber is mechanically or chemically sealed to the light housing in order to provide a hermetic seal.

The need for mechanical or chemical sealing in the light assembly process disadvantageously results in additional manufacturing steps and material. Every step in the assembly process adds time, complexity and expense to the manufacturing process. Thus, a reduction in the number of steps needed to accomplish assembly has a direct impact on lowering the manufacturing time and costs of the light assemblies. Furthermore, there are additional costs associated with stocking the increased number of parts or materials used in mechanically or chemically sealing EPDM. Thus, a reduction in the parts or material used to seal the light assemblies has a direct impact on lowering the manufacturing time and costs of the light assemblies.

Similarly, the manufacturing cost of the light assemblies has a direct impact on the overall cost of a vehicle. Thus, as the process of manufacturing the light assemblies is simplified, the cost of manufacturing can be reduced as increased manufacturing efficiency is realized.

Throughout the above processes, quality is an important consideration. The seal between the reflectors and the light assembly housings must be sufficiently robust that the performance of the light assemblies is not degraded by mishandling during manufacture, shipment and vehicle assembly processes. Furthermore, depending on the application, light assemblies must function reliably under severe operational conditions such as severe shock and vibration, a wide range of temperature, and exposure to water, oil and dirt.

It is desirable, therefore, to provide a hermetically sealed light assembly that does not require additional parts or materials. It is further desired that the light assembly be of simple and reliable construction. Moreover, it is desired that the light assembly not be of increased cost as compared to known light assemblies in the prior art while providing a reliable seal.

BRIEF SUMMARY OF THE INVENTION

In accordance with the present invention, a hermetically sealed light assembly is provided which overcomes the disadvantages of the prior art. According to the present invention, a thermoplastic elastomer boot of flexible or rigid design, is welded to a polypropylene housing to obtain a hermetic seal.

The invention provides a hermetically sealed light assembly that does not require additional parts or materials compared to light assemblies of the prior art. Furthermore, the light assembly is simple to manufacture and provides a robust seal. Moreover, the cost of materials for the light assembly is not increased compared to prior art light assemblies.

DETAILED DESCRIPTION OF THE INVENTION

Figure 1:
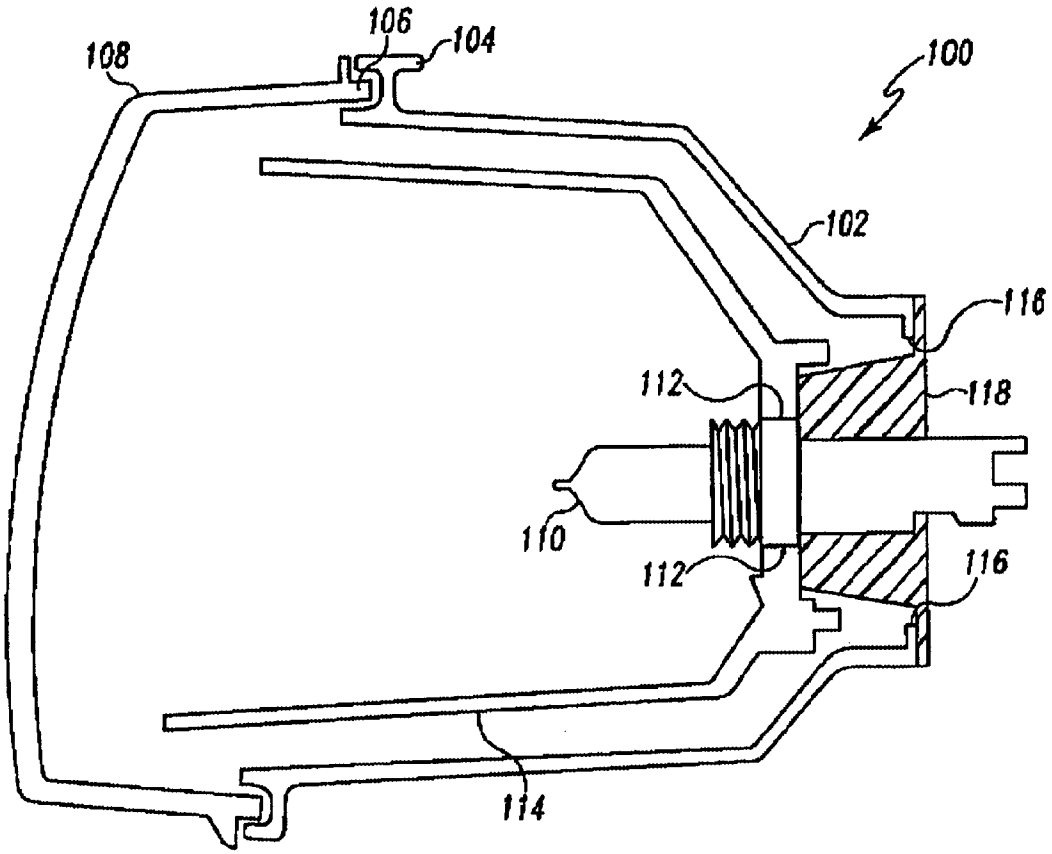
FIG. 1 is a schematic side plan view of a vehicle lighting assembly housing in accordance with an exemplary embodiment of the present invention.

An exemplary embodiment of the present invention is described in reference to FIG. 1. FIG. 1 generally illustrates vehicle lighting assembly 100. Housing 102 is formed with groove 104 which accepts lip 106 of lens 108. A seal is achieved between lip 106 and groove 104 by methods known in the art, such as by hot melting or the like. Reflector 114 is located within housing 102 and comprises opening 112 at the rearward portion of reflector 114. Bulb 110 is located within opening 112 of reflector 114. Opening 112 of reflector 114 is substantially aligned with opening 116 of housing 102, which is located at the rearward end of housing 102. Boot 118 is sealingly engaged at one end to housing 102 at opening 116. Boot 118 is sealingly engaged at the other end to reflector 114.

In the embodiment of FIG. 1, reflector 114 is adjustable. Accordingly, reflector 114 is movable relative to housing 102. Therefore, boot 118 must be of a type which allows for relative motion between housing 102 and reflector 114 while maintaining a hermetic seal at opening 116 and opening 112. In the embodiment of FIG. 1, this is achieved by constructing boot 118 from a thermoplastic elastomer (TPE), such as SANTOPRENE (SANTOPRENE is a registered trademark of, and commercially available from, Advanced Elastomer Systems, L.P. of Akron Ohio.). TPEs such as SANTOPRENE are synthetic products which may be produced so as to exhibit flexibility and durability similar to that of rubber material. These TPEs exhibit high tear strength and resistance to fatigue. TPEs can be produced in varying degrees of hardness and flexibility, from a membranous like product with a significant amount of flexibility to a rigid product. Even a rigid product, however, may be produced with a significant degree of elasticity.

When using a flexible TPE material, the boot may be in the shape of a simple cone or cylinder as shown in FIG. 1. The physical characteristics of the TPE will allow for the required relative motion between the housing and the reflector in the axial direction (forward-rearward axis) as well as any off-axial motion. Alternatively, a more rigid TPE may be desired. In these applications, the elastic nature of the TPE may be relied upon to allow for the required relative motion between the housing and the reflector. An alternative embodiment of the invention which relies upon the elastic nature of the TPE is discussed with reference to FIG. 2 and FIG. 3.

Figure 2:
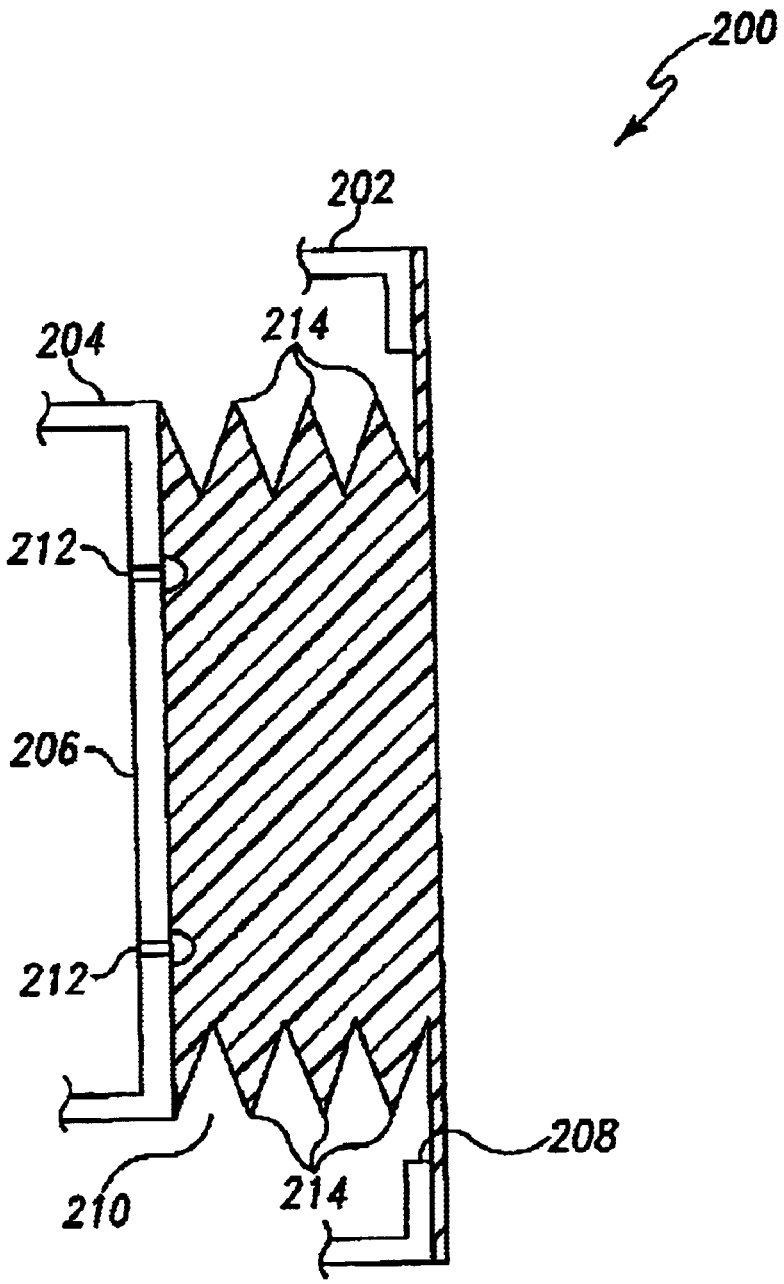
FIG. 2 is an enlarged partial schematic side plan view of a lighting assembly housing showing an alternative embodiment of a boot according to the present invention in an extended state.

FIG. 2 is an enlarged partial schematic side plan view of a lighting assembly housing showing an alternative embodiment of a boot according to the present invention in an extended state. Lighting assembly housing 200 comprises housing 202. Reflector 204 is located within housing 202. Access to base 206 of reflector 204 is provided by opening 208 in housing 202. Base 206 may be used to provide a means for mounting a light bulb (not shown) within reflector 204. Boot 210 comprises a plurality of ribs 214. Boot 210, which is made from a TPE, is sealingly engaged at one end to base 206 of reflector 204. A hermetic seal may be achieved according to any means known to those of skill in the relevant art. By way of example, but not of limitation, boot 210 may be sealed to base 206 by using an o-ring and a washer. In such an embodiment, screws 212 may be used to force the washer and o-ring against base 206 to achieve the hermetic seal.

Boot 210 is sealingly engaged at the other end to housing 202 at opening 208. In the embodiment of FIG. 2, housing 202 comprises a thermoplastic polymer (TPP) such as polypropylene. Thermoplastic materials soften when subjected to heat, but do not cure or set when subsequently cooled. Accordingly, thermoplastic materials may be heated and injected molded into various forms. Upon cooling, the thermoplastic will harden into the shape of the mold, such as a light assembly housing. However, because the thermoplastic does not cure, the thermoplastic housing may be re-melted. This is beneficial since the thermoplastic housing may be joined to other items through various forms of welding such as, but not limited to, hot gas welding, spin welding, fusion welding, butt welding, ultra-sonic welding, vibration welding, IR welding or LASER welding.

As discussed above, boot 210 is made from a TPE. TPE's can be thought of as comprising two phases. One phase is a soft phase, which imparts the rubber like characteristics of the TPE. The other phase is a hard phase, which is essentially a thermoplastic phase. Accordingly, the TPE may also be welded. Thus, boot 210 may be welded to housing 202. Welding has many advantages over chemical or mechanical sealing. For example, the time for joining is reduced compared to adhesive bonding. Moreover, the weld typically exhibits a high strength, and does not require additional chemicals or parts.

The ability to weld the TPE is influenced by the rubber content (soft phase) of the material. Thus, as the amount of soft phase material increases, the weldability of the TPE decreases. In practice, it has been discovered that using a TPE with a hardness of about 95 Shore A or 55 Shore D produces a boot which can be effectively welded while retaining sufficient flexibility to allow for relative motion between the housing and the boot of a light assembly.

Figure 3:
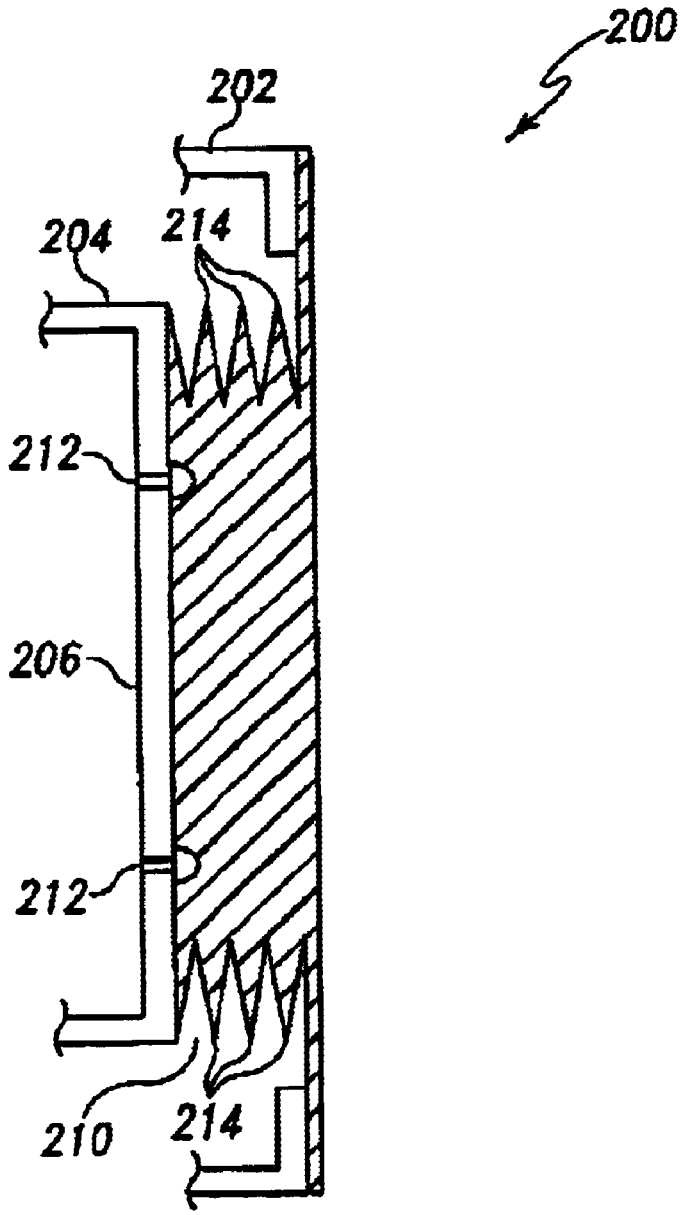
FIG. 3 is an enlarged partial schematic side plan view of the lighting assembly housing of FIG. 2 showing the boot in a compressed state.

Referring now to FIG. 3, the lighting assembly housing of FIG. 2 is shown with boot 210 in a compressed state. Because boot 210 is elastic and made in a bellows shape, reflector 204 may be moved in an axial direction without compromising the seal between boot 210 and reflector 204 or housing 202. As compared to FIG. 2, FIG. 3 shows reflector 204 moved axially toward housing 202, compressing boot 210. Those of skill in the art will understand that a variety of alternative shapes may be used in practicing the present invention such as, but not limited to, bulbous or hour-glass shapes. Moreover, the bellows may comprise fewer or additional ribs as compared to the embodiment of FIG. 2 and FIG. 3. These and other variations being within the scope of the present invention.

Those of skill in the art will realize that as described herein, the present invention provides significant advantages over the prior art. The invention provides a hermetically sealed light assembly that does not require additional parts or materials compared to light assemblies of the prior art. Furthermore, the light assembly is simple to manufacture and provides a robust seal. Moreover, the cost of materials for the light assembly is not increased compared to prior art light assemblies.

While the present invention has been described in detail with reference to a certain exemplary embodiment thereof, such is offered by way of non-limiting example of the invention, as other versions are possible. It is anticipated that a variety of other modifications and changes will be apparent to those having ordinary skill in the art and that such modifications and changes are intended to be encompassed within the spirit and scope of the invention as defined by the following claims.

We claim:

1. A lamp assembly, comprising:

a housing having a first rearward opening;

an adjustable reflector mounted within the housing, the reflector having a second rearward opening, the first rearward opening of the housing substantially aligned with the second rearward opening of the reflector; and a flexible boot having a first end welded to the housing about the first rearward opening of the housing and a second end sealable to the reflector.

2. The lamp assembly of claim 1, wherein the housing comprises a thermoplastic polymer and the boot comprises a thermoplastic elastomer.

3. The lamp assembly of claim 2, wherein the boot comprises a thermoplastic elastomer having a hardness of about 95 Shore A.

4. The lamp assembly of claim 3, wherein the housing comprises polypropylene.

5. The lamp assembly of claim 2, wherein the boot comprises a thermoplastic elastomer having a hardness of about 55 Shore D.

6. The lamp assembly of claim 5, wherein the housing comprises polypropylene.

7. A lamp assembly comprising, a housing having a rearward opening, the housing comprising polypropylene, an adjustable reflector mounted within the housing, the opening in the housing substantially alligned with the rear of the reflector, and a boot having a first and a second end, the first end cohered to the housing about the rearward opening of the housing and the second end sealable to the reflector, the boot comprising a thermoplastic elastomer and cohered to the housing by welding.

8. A method of making a lamp assembly, comprising the steps of forming a housing having a first rearward opening, mounting within the housing an adjustable reflector with a second rearward opening so that the second rearward opening of the reflector is aligned with the first rearward opening of the housing, forming a flexible boot having a first and second end, the first end of the boot to the housing about the rearward opening of the housing, and forming a seal between the second end of the boot and the reflector.

9. The method of claim 8, wherein the step of forming a housing comprises the step of forming a housing from a thermoplastic polymer and the step of forming a boot comprises the step of forming a boot from a thermoplastic elastomer.

10. The method of claim 8, wherein the step of forming a housing comprises the step of forming a housing comprised of polypropylene, and the step of forming a boot comprises the step of forming a boot comprised of a thermoplastic elastomer having a hardness of about 95 Shore D.

11. The method of claim 8, wherein the step of forming a housing comprises the step of forming a housing comprised of polypropylene, and the step of forming a boot comprises the step of forming a boot comprised of a thermoplastic elastomer having a hardness of about 55 Shore A.

12. A method of making a lamp assembly comprising the steps of, forming a housing having a rearward opening, the housing comprising polypropylene, mounting within the housing an adjustable reflector, the opening in the housing substantially aligned with the rear of the reflector, forming a boot having a first and a second end, the second end sealable to the reflector, the boot comprising a thermoplastic elastomer, and cohering the first end to the housing about the rearward opening of the housing by welding.

* * * * *